United States Patent [19]

Takahashi et al.

[11] Patent Number: 4,777,512

[45] Date of Patent: Oct. 11, 1988

[54] IMAGE FORMING APPARATUS WITH DELAY DURING TONER REPLENISHMENT

[75] Inventors: Masayoshi Takahashi, Chofu; Nobutoshi Yoshida; Ikumi Omura, both of Yokohama; Tatsuya Tada, Kawasaki, all of Japan

[73] Assignee: Canon Kabushiki Kaisha, Tokyo, Japan

[21] Appl. No.: 939,866

[22] Filed: Dec. 9, 1986

[30] Foreign Application Priority Data

Dec. 11, 1985 [JP] Japan ..... 60-278715
Dec. 11, 1985 [JP] Japan ..... 60-278487

[51] Int. Cl.[4] ..... G03G 15/00

[52] U.S. Cl. ..... 355/14 D; 355/3 DD; 355/14 R

[58] Field of Search ..... 355/3 DD, 14 D, 14 R, 355/3 R, 14 D, 14 E; 118/658, 689, 690, 691; 222/DIG. 1

[56] References Cited

U.S. PATENT DOCUMENTS 4,032,227 6/1977 Hubbard et al. ..... 355/14 D

*Primary Examiner*—A. T. Grimley
*Assistant Examiner*—E. Pipala
*Attorney, Agent, or Firm*—Fitzpatrick, Cella, Harper & Scinto

[57] ABSTRACT

An image forming apparatus using two component developer. When a toner content in the developer becomes out of a predetermined range as a result of the consumption of the toner, a control device effects a toner replenishing operation, and simultaneously, the image forming operation is substantially delayed.

8 Claims, 7 Drawing Sheets

IMAGE FORMING APPARATUS WITH DELAY DURING TONER REPLENISHMENT

FIELD OF THE INVENTION AND RELATED ART

The present invention relates to an image forming apparatus such as a copying apparatus, a printer and a display device, more particularly to such an image forming apparatus wherein an electrostatic latent image or a magnetic latent image is developed by two component developer.

In a developing device using a developer containing toner particles and magnetic particles, only the toner particles are consumed during the developing operation, and therefore, the toner content in the developer gradually decreases with development, resulting in decrease of the image density of the developed image, if no particular control is employed. In order to maintain a proper toner content of the developer irrespective of the toner consumption, it is required that the current toner content is quickly detected, that proper amount of the toner is supplied at proper times in accordance with the detection, that the supplied toner is quickly mixed with the existing developer to constitute a uniform mixture, and that the developer is quickly moved to the toner content detecting device.

Therefore, the developing device of this type comprises means for detecting the toner content of the developer contained in the developer container, means for stirring and conveying the developer in the developer container, means for containing the toner to be supplied, and means for conveying the toner in the toner container to the developer container. In operation, the reduction of the toner content with time is detected in the toner container by the toner content detecting means, the output of which is introduced into a control circuit, which in turn actuates the supply toner conveying means when the detected toner content reaches the predetermined lower limit so as to supply a part of the toner particles in the supply toner container into the developer container. The supplied toner is quickly mixed with the developer existing in the developer container, by the developer stirring and conveying means. After the toner supply, the toner content detecting means detects that the toner content in the developer container increases to a satisfactory extent, the supply toner conveying means is deactivated. In this manner, the toner content of the developer in the developer container is automatically maintained substantially at a constant level.

This technique is disclosed in U.S. Pat. No. 4,462,680 which has been assigned to the assignee of the present application, and the similar techniques are disclosed in U.S. Pat. Nos. 3,892,672; 4,155,638; 4,266,141; 4,343,548 and 4,357,901.

SUMMARY OF THE INVENTION

In order to meet the recent trend toward the reduction of the size of the image forming apparatus, it is necessary to contain the developing device within a small space in the copying machine, and therefore, the developing device is required to be smaller in size, relatively elongated and flatter. For this reason, the developer container for containing the two component developer becomes small. This tendency is seen also in the field of printing machines. Then, the space in the developer container usable for stirring the developer has to become smaller. New problems arise from this smaller space available. When the toner is replenished into the developer container to compensate the consumed toner, the toner has to be sufficiently stirred and mixed with the existing developer including the carrier particles. The stirring and mixing operations have to be performed in the smaller space, since the region is smaller where the proper stirring effect can be provided. Therefore, when a large amount of toner is supplied in order to make possible the high speed image formation or in response to the toner replenishing signal, the sufficient mixing and stirring operation is not possible, with the result of the foggy image or the toner scattering. On the contrary, if the amount of the toner replenishment per unit time is reduced, the mixing and stirring of the developer are sufficient, but the sufficient amount of toner can not be supplied, with the result of the decrease of the image density or other defects. This occurs particularly when an original having a large image area or an original having a relatively large solid black image is processed, which consumes a large amount of the toner. This is, of course, more remarkable when such images are copied.

In view of those problems, it is a principal object of the present invention to provide an image forming apparatus wherein the toner replenishing operation is properly effected to maintain the quality of the resultant image.

It is another object of the present invention to provide an image forming apparatus wherein the image quality of the developed image, more particularly, the image density can be maintained, whatever toner content detecting means is used.

It is a further object of the present invention to provide an image forming apparatus which is small in size, wherein the mixing and stirring operations are sufficiently effected even if the mixing and stirring region in the container is small, so that the image quality can be maintained.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENT

(1) General arrangement of the image forming apparatus (copying apparatus)

Figure 1:
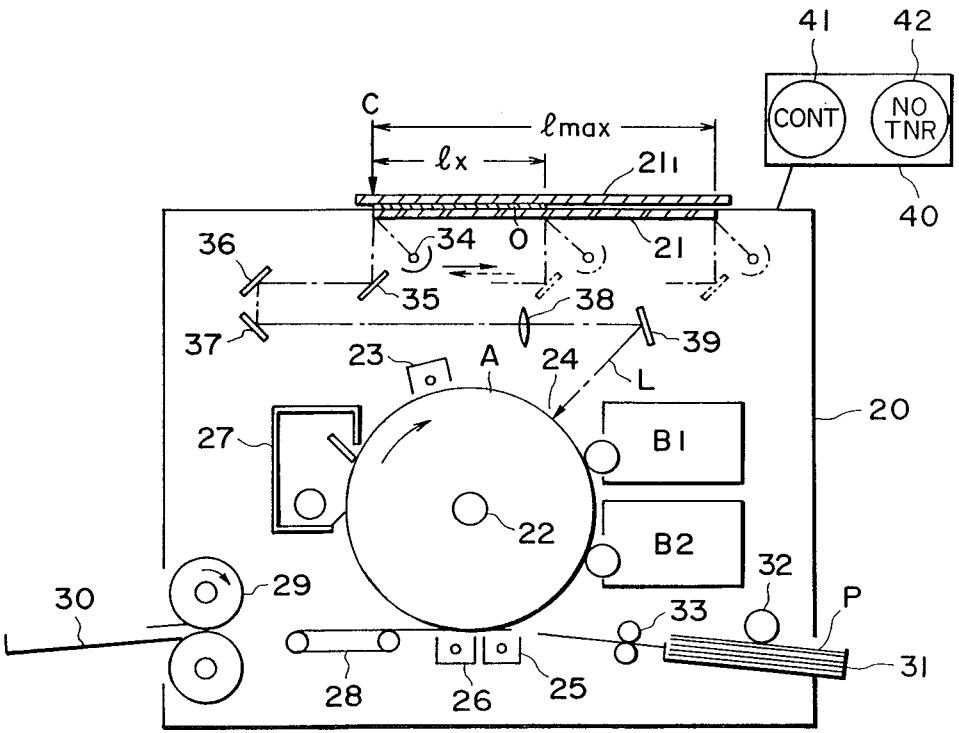
FIG. 1 is a sectional view of a copying apparatus as an example of the image forming apparatus according to an embodiment of the present invention.

Referring to FIG. 1, there is shown a copying apparatus as an example of the image forming apparatus according to an embodiment of the present invention. The copying apparatus comprises a casing 20 and an original supporting platen glass 21 provided in a window formed in a top side of the casing 20. When a copy is to be taken, an original O is placed on the platen glass upside down in alignment with a reference line C. The top of the original O placed on the glass platen is covered by an original pressing plate $21_1$ having the bottom white reflecting surface.

A display means 40 is provided on the top surface of the casing 20 and includes a first display portion 41 for displaying the fact that a control means for controlling the toner content is in operation, which will be described in detail hereinafter, and a second display portion 42 for displaying "no toner", which will be described in detail hereinafter. The type of the display may be of any conventional one, flickering type, character display type, light-on type or another.

The image forming apparatus further includes an electrophotographic photosensitive member A in the form of a drum (a photoconductor such as selenium and silicon), which will be called hereinafter simply "photosensitive drum". The photosensitive drum is a latent image bearing member and is supported on a shaft 22, about which it is rotatable at a predetermined speed in the direction indicated by an arrow. A corona discharger 23 functions to apply uniform positive or negative electric charge to the surface of the photosensitive drum A. The apparatus further includes a light image exposure station 24 for exposing the photosensitive drum A through a slit to a light image, first and second developing devices B1 and B2, corona discharger 25 for transferring a developed image onto a transfer material, a corona discharger 26 for separating the transfer material from the photosensitive drum A, a cleaner 27 for cleaning the photosensitive drum A, an image fixing device 29, a conveying device for conveying to the image fixing device 29 the transfer material P separated from the photosensitive drum A by the separation discharger 26. The image forming apparatus further comprises a transfer material discharge tray 30, a cassette 31 for containing the transfer materials P, a pick-up roller 32 and registration rollers 33.

In this embodiment, the first and second developing devices B1 and B2 respectively contain different color developers and are selectively usable.

In the space between the original supporting plate 21 and the photosensitive drum A, an original illuminating and scanning mechanism 34–39 is provided which is of an optical system moving type, comprising an original illuminating light source 34, a first mirror 35, a second mirror 36, a third mirror 37, an imaging lens 38 and a fourth mirror 34.

The light source 34 and the first mirror 35 are supported on a common carrier and reciprocable along the bottom surface of the platen glass. The home position thereof is predetermined adjacent the lefthand side of the platen glass 21. They, are movable together from the home position toward the righthand side at a predetermined speed and are returned in the opposite direction.

The second and third mirrors 36 and 37 are supported on a common carrier. They are movable in the forward direction in synchronism with the light source 34 and the first mirror 35 at a speed of one half that the mirror 35. The second and third mirrors 36 and 37 move back together with the backward movement of the first mirror. The imaging lens 38 and the fourth mirror 39 are stationary.

The image side of the original on the platen glass 21 is scanned from the lefthand side to the righthand side by the reciprocal movements of the turned-on light source 34, the first mirror 35, the second mirror 36 and the third mirror 37, and the photosensitive drum A surface is exposed continuously through slit at the exposure station 24 with the light image of the original.

Prior to the copying operation, the original O is placed on the original supporting platen glass 21, and various parameters are set in an unshown console, such as the number to be copied, the size of the copy and the color. Then, the copy button is depressed. The selection of the color is performed by a switch for selecting one of the first and second developing devices B1 and B2, and the selected developing device is placed under the condition that it is actable on the photosensitive drum A.

When the photosensitive drum A starts to rotate, the other processing means are operated, thus starting the copy process operation. More particularly, the rotating photosensitive drum A is uniformly charged by the discharger 23 and is exposed to the image light of the original through the slit by way of the scanning mechanism 34–39 at the exposure station 24, so that an electrostatic latent image is formed continuously on the surface of the photosensitive drum in accordance with the image of the original.

The electrostatic latent image is developed by the selected developing device, the first or second developing device B1 or B2 into a toner image. On the other hand, the transfer material P is fed out of the paper supply station 31, 32 and 33 in synchronism with the rotation of the photosensitive drum A. The toner image is transferred onto the transfer material P fed to between the photosensitive drum A and the discharger 25, by the operation of the discharger 25.

The transfer material P now having the toner image is then separated gradually from the surface of the photosensitive drum A by the separation discharger 26 and is conveyed by the conveying device 28 into the image fixing device 29, where the toner image is fixed. The transfer paper is subsequently discharged to the discharge tray 30. On the other hand, the photosensitive drum A, after the toner image has been transferred therefrom, is subjected to the cleaning operation by the drum cleaner 27, and becomes ready for next the image forming operation.

The scanning distance lx by the illuminating source 34 and the first mirror 35 is automatically controlled in dependence on the size of the copy, the size of the transfer material or the size of the set original. The distance lmax is the largest scanning length of the apparatus.

Figure 2:
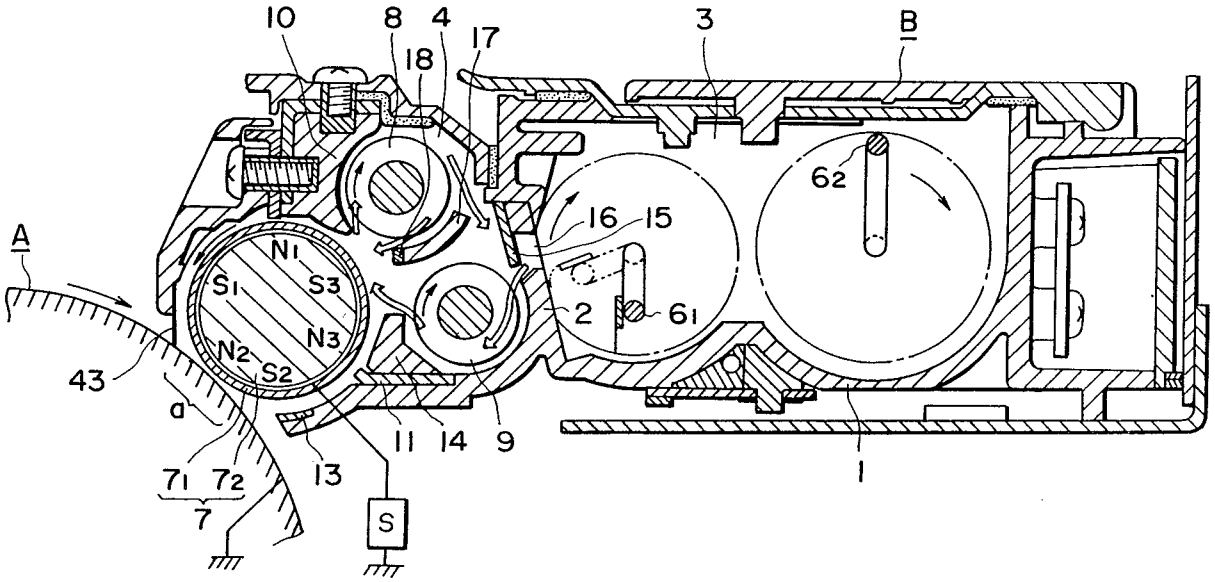
FIG. 2 is an enlarged sectional view of the image forming apparatus of FIG. 1.

(2) Developing device (FIG. 2)

In this embodiment, the first and second developing devices B1 and B2 have the same structure as in the first embodiment except that the colors of the developers contained are different. Therefore, one developing device is illustrated in FIG. 2 in a large scale as a developing device B. The developing device 2 includes a developer container 1 having inside space divided by a partition wall 2 into a toner containing portion 3 and a developer containing portion 4 which contains a developer comprising the toner and magnetic particles. In this Figure, the toner in the toner container 3 and the developer in the developer container 4 are omitted for the sake of simplicity. The toner in the toner container 3 is advanced toward the partition wall 2 by the rotation of the toner conveying members $6_1$ and $6_2$. The toner thus advanced is supplied into the developer container 4 through the toner supply aperture 16.

In the developer container 4, there is provided a developer carrying member 7 comprising a developing sleeve $7_1$ of non-magnetic material and a magnet roll $7_2$ enclosed therein. The developing sleeve $7_1$ is exposed outside through an opening of the developer container 4 at the lower left portion. The developing device B is disposed with respect to the photosensitive drum A such that the exposed surface of the developing sleeve $7_1$ is opposed to the photo-sensitive member A surface with a predetermined small gap.

The references S1–S3, N1–N3 indicate the positions and polarities of the magnetic poles of the magnet roll $7_2$. The magnet roll $7_2$ is stationary because the longitudinal ends thereof are fixed to the frame of the developing device. The developing sleeve $7_1$ is rotatable outside the magnet roll $7_2$ at a predetermined peripheral speed and in the predetermined direction indicated by an arrow.

In the developer container 4, screw shafts 8 and 9 are disposed substantially one above the other and substantially in parallel with the developing sleeve $7_1$ and are effective to stir and convey the developer. They are driven to rotate in the directions indicated by an arrow. Between the upper and lower screw shafts 8 and 9, there is a member 17 to control or regulate the circulation of the developer in the developer container.

The developing device further comprises circulation region limiting members 10 and 14 disposed at a upper portion and a lower portion in the developer container 4 to limit the circulation region around the peripheral surface of the developing sleeve $7_1$. A magnetic member 11 and a magnet 13 are provided adjacent the bottom of the developer container 4 to prevent the developer from leaking from the developer container toward the latent image bearing member A through the clearance between the bottom of the developer container 4 and the bottom surface of the developing sleeve $7_1$. A blade member 12 of nonmagnetic material is fixed to the frame of the developing device such that its end is spaced with a small clearance from the upper surface of the developing sleeve $7_1$, whereby in operation the thickness of the layer of the developer formed on the developing sleeve $7_1$ is controlled.

A sensor 15 is provided to detect the content of the developer (the mixture ratio between the toner and the magnetic particles) of the developer in the developer container 4. The sensor produces an output which is introduced into a control circuit (not shown), in response to which the rotational drive of the toner conveying members $6_1$ and $6_2$ in the toner container 3 is controlled. The sensor 15 is disposed along or across the passage of the mixed developer, and may be of any known type.

In operation, the developing sleeve $7_1$, screw shafts 8 and 9 are rotated at predetermined speeds, while an alternating voltage is applied by a bias source S between the developing sleeve $7_1$ and the photosensitive drum A.

By the rotations of the screw shafts 8 and 9, the developer in the developer container 4 is sufficiently stirred along the length of the developing sleeve $7_1$, so that a substantially uniform mixture ratio between the toner and the magnetic particles is provided adjacent the developing sleeve $7_1$, whereby the unevenness is substantially removed along the longitudinal direction of the developing sleeve $7_1$.

The screw shafts 8 and 9 are rotated in the directions indicated by the arrows in FIG. 2. The screws on the respective shafts are so formed that the developer in the neighborhood of the respective screws are moved longitudinally in the opposite directions when the screws are rotated in the above directions. For example, the developer around the screw shaft 8 moves in the longitudinal direction from the rear side to the front side of the developer container 4, while the developer around the screw shaft 9 moves from the front side to the rear side.

The length and the interval of the screw blade of the screw shaft 9 is larger than those of the shaft 8 so that the lower screw shaft 9 provides a stronger developer conveying force in the longitudinal direction, that is, the lower screw shaft 9 has stronger conveying force than the upper screw shaft 8.

The developer moves in the developer container 4 in the cross section of FIG. 2 in the manner indicated by thick arrows due to the rotation of the developing sleeve $7_1$, rotations of the screw shafts 8 and 9, the magnetic field of the magnet roll $7_2$, the limiting members 10 and 11, the regulating member 17, the friction between the developing sleeve $7_1$ and the developer and the gravity force to the developer. The developer, that is, the magnetic powder containing the toner powder, adjacent the surface of the sleeve $7_1$ is attracted onto the developing sleeve $7_1$ surface by the magnetic force provided by the magnet roll $7_2$ in the developing sleeve $7_1$, and are conveyed to the nonmagnetic blade 12 by the rotation of the developing sleeve $7_1$. When the developer passes under the nonmagnetic blade 12, the layer of the developer on the sleeve $7_1$ is regulated in its thickness, whereby a thin layer of the mixture of the toner and a small amount of magnetic particles is formed, which is conveyed to the developing position a where the photosensitive drum A and the developing sleeve $7_1$ are opposed to each other in the neighborhood of the magnetic pole N2.

The toner in the developer layer on the developing sleeve $7_1$ is transferred to the latent image pattern on the photosensitive drum A due to the electric field in the developing position and the magnetic field provided by the magnet pole N2, whereby the latent image on the photosensitive drum A is continuously developed.

The developer layer remaining on the sleeve $7_1$ after passing through the developing position a is conveyed on the sleeve $7_1$ back into the developer container 4, while being maintained thereon by the magnetic field provided by the magnet poles S2 and N2. The returned developer is then mixed with the developer existing in the developer container 4. With use, the toner content in the developer decreases since the toner is consumed for the development. The decrease is detected by the sensor 15, and the output thereof is transmitted to an unshown control circuit. When the decrease reaches a predetermined lower limit, a signal is produced, in response to which the toner supplying members $6_1$ and $6_2$ in the toner container 3 are driven, whereby the toner is supplied from the toner container 3 through the toner supply aperture 16 into the developer container 4.

The supplied toner is mixed with the developer existing in the developer container 4 into uniform mixture, quickly. Then, the toner content of the developer in the developer container 4 increases, and when the sensor 15 detects that it reaches the upper limit, the toner supplying members $6_1$ and $6_2$ stop. In this manner, the ratio of the toner to the magnetic particles in the developer in the developer container 4 is maintained substantially constant, whereby high quality images can be provided stably.

The toner supplied through the toner supply aperture 16 into the developer container 4 is moved into the existing developers by the lower screw shaft 9 in the longitudinal direction, and therefore, it is stirred, conveyed, dispersed and mixed. The developer moves on the developing sleeve $7_1$, and the circulation thereof is limited between the limiting member 17 and the magnet pole S3 and is mixed with the developer on the sleeve $7_1$ returned into the developer container 4 after development and with the developer conveyed by the screw shaft 8. A part of the developer is moved to the screw shaft 8, and another part to the non-magnetic blade 12 through the limiting member 10 and is controlled in its thickness. Then, the developer is conveyed on the developing sleeve $7_1$ to the developing station a and is consumed for developing the latent image. The developer conveyed to the screw shaft 8 is moved along the screw shaft 8 in the direction opposite to that of the screw shaft 9, and a part thereof is directed to the sleeve $7_1$, and the remaining to the screw shaft 9. When the developer moves longitudinally by the screw shaft 8, the developer adjacent the sleeve $7_1$ surface is made uniform along the entire length of the sleeve.

The developer circulation limiting member 17 serves adjacent the sleeve $7_1$ to limit the circulation and conveyance of the developer adjacent the magnet pole S3, while it serves as a guiding plate with respect to the screw shaft 8 and 9 to provide stabilized stirring and conveyance of the developer. Also, at the side remote from the sleeve $7_1$, it forms a clearance with the developer container 1 to guide a part of the developer circulated and conveyed by the screw shaft 8 toward the screw shaft 9.

The developer circulation limiting member 17 may have a magnetic member 18 at its end near the sleeve $7_1$ so that a magnetic field is produced between itself and the magnetic pole S3, and therefore, the circulation of the developer on the sleeve $7_1$ adjacent the magnetic pole S3 can be more strongly limited. In this case, the magnetic member 18 may be a magnet, or otherwise, the limiting member 17 itself may be made of magnetic material. When the magnet is used, the magnetic pole thereof is opposite to that of the magnetic pole S3 with the result of stronger limitation to the developer circulation, or may be the same as that of the magnetic pole S3 with the result of better circulation, and therefore, better exchanging between the upper developer and the developer in the container 4, which has been observed visually.

In this embodiment, the toner content detecting sensor 15 is of the type wherein a sensor voltage is induced by an alternating field applied to the developing sleeve $7_1$, and the sensor voltage is changes with the ratio of the toner to the magnetic particles (the toner content of the developer). The developer conveyed by the screw shaft 9 changes in its volume depending on the mixture ratio between the toner and the magnetic particles and covers the sensor 15, whereupon the sensor voltage changes with the mixture ratio. The output of the sensor is transmitted to the control circuit as the current toner content information.

As for the elements usable as the sensor 15, there are a piezoelectric element, an inductance change detecting element, and antenna system using an alternating bias.

Figure 3:
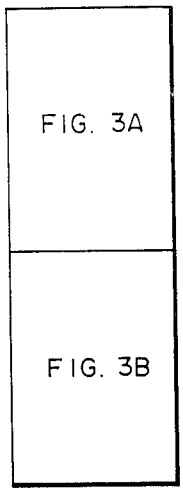
FIG. 3 is a flow chart illustrating the operation of FIG. 1 apparatus.
Figure 3A:
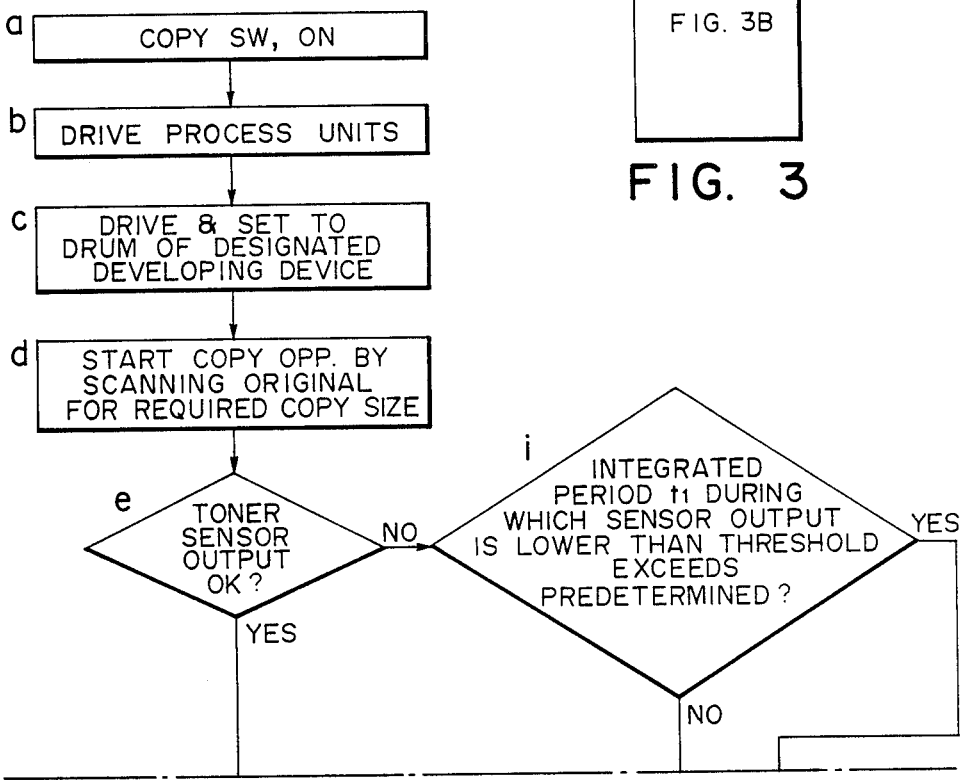
Figure 3B:
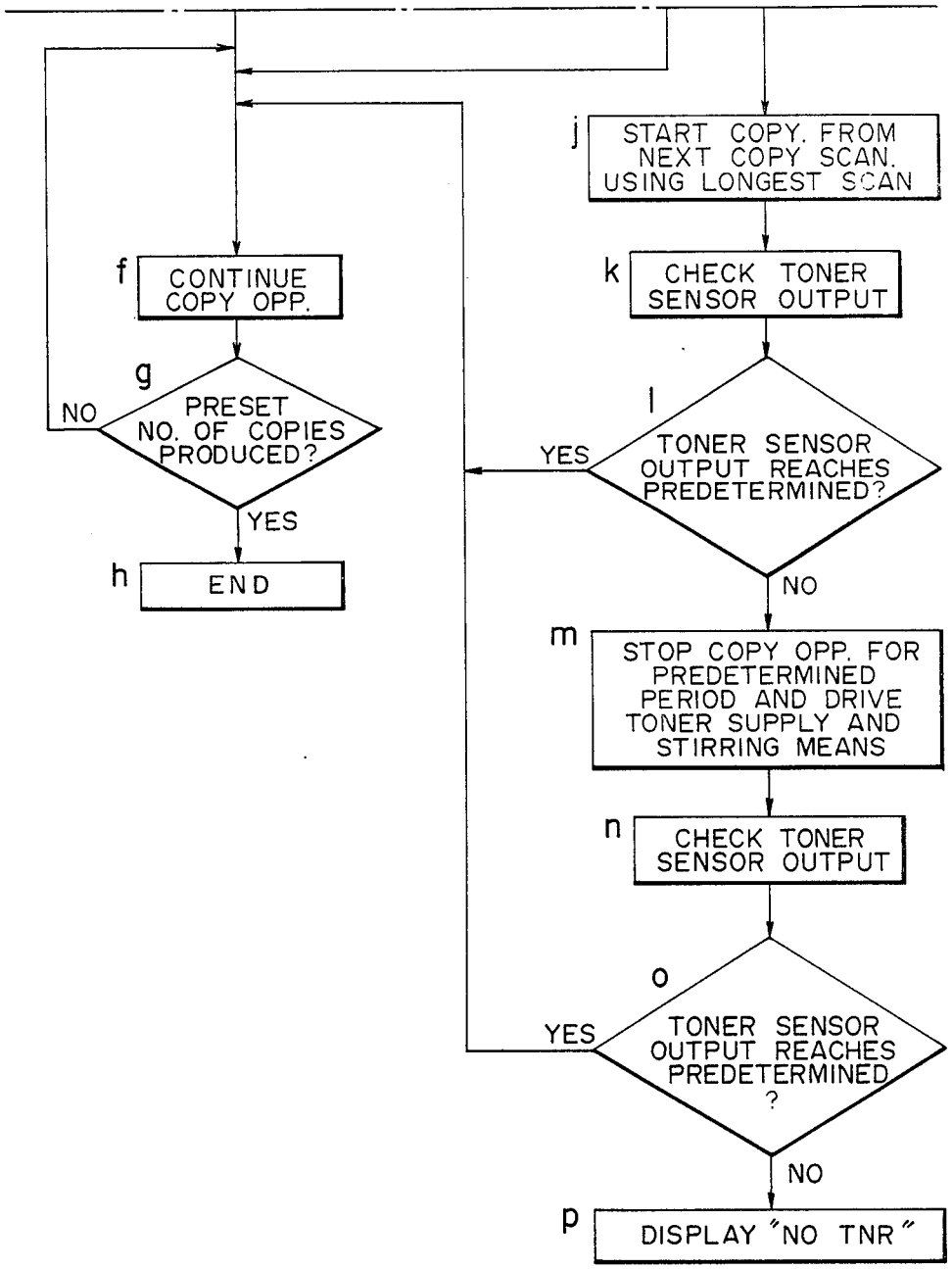

(3) The interrelation between the copying sequence and the toner replenishing sequence Referring to FIG. 3, there is shown an interrelation between the copying sequence and the toner replenishing sequence.

STEPS a–d

An original O is placed on the original supporting platen 21; various copying parameters are set; and then the copy start switch is actuated. Then, the various process means of the copying apparatus start operating; the set and selected developing device B1 or B2 is made applicable to the photosensitive drum A, and the original scanning for the required size of the copy starts.

STEPS e–h

During prosecution of the copying operation, the toner content controlling system checks whether the toner content of the developer in the developer container 4 is at a predetermined level or not; as long as it is at the predetermined level (yes), the copying operation is carried out under the normal copying sequence so as to provide a predetermined number of copies.

STEP i

When it is detected that the decrease of the toner content with the execution of the copying operation reaches a predetermined level, the toner content control system discriminates whether the integrated time period $t_1$ during which the output of the sensor 15 is lower than a threshold level is larger or not than a predetermined time period. If not, the amount of the toner replenishment per unit time from the toner container 3 to the developer container 4 is balanced or is larger than the toner consumption per unit time by the copying operation. In this case, the toner is replenished from the toner container 3 to the developer container 4, and the normal copying sequence is executed without change.

STEPS j–l

If the answer to step i is affirmative, it means that the toner consumption is larger than the toner replenishing amount. In this case, the next copying operation is effected with the longest scanning length lmax, during which the toner replenishing operation is carried out continuously until the toner content reaches the predetermined. By this, the time required for the toner replenishment can be provided without ceasing the copying operation. In this operation, the surface of the photosensitive drum A corresponding to the outside of the copy size (the area corresponding to lmax–lx) is exposed to uniform light, so that the toner is not deposited on the additional surface so as to prevent wasteful consumption of the toner.

When the output of the toner sensor 15 reaches the predetermined (step l, yes), the copying operation returns to the normal operation and is continued.

At step k, the toner sensor output check may be performed immediately after the longest scanning operation, a predetermined period after the scanning operation or after plural of such scanning operations.

STEPS m–o

If the answer to the step l is negative, it means that the compensation of the toner consumption per unit time is not possible even if the copying operation is effected with the longest scanning distance lmax, during which the toner is replenished continuously. In this case, the copying operation is stopped for a predetermined period, and the fact is displayed on the console, during which the toner replenishing operation is performed. When the output of the toner sensor 15 reaches the predetermined level (step o, yes), the stopping of the copying operation is released, and thereafter, the normal copying sequence is re-executed.

STEP p

If the answer to step o is negative, it is discriminated that there is no toner in the toner container 3, and "no toner" is displayed on the console.

In this manner, at least at the time of small size copy, only the required size is developed, whereby the additional time can be saved until the next developing operation, so that the toner replenishing and stirring operation can be sufficiently carried out without stopping the copying operation, with the result of the formation of the copied image (steps e-i-j-k-f, in this order) stably outputted.

During the additional time period saved by the maximum length scanning operation or the scanning operation longer than the required copy size, it is preferable that the toner deposition onto the photosensitive member is prevented so as to avoid the wasteful consumption of the toner. This can be accomplished by the original pressing plate $\mathbf{21}_1$ having white plate which is illuminated by the illumination lamp 34 to provide reflected light to expose the entirety of the photosensitive member surface outside the copy size to uniform light so as to dissipate the electric charge thereon; by providing a whole surface exposure lamp to expose the necessary area of the photosensitive member to uniform light; by switching the developing bias to prevent the toner deposition onto the photosensitive drum; or by not applying light to the photosensitive member in the case of a reversal development.

As described in the foregoing, according to this embodiment of the present invention, the copying sequence is interrelated with the toner supplying sequence so as not to cease the continuous copying operation, by saving the time required for the toner replenishment and stirring so as to prevent the decrease of the toner content of the developer. More particularly, at least when a small size copy is taken, the length of the original scanning operation is deliberately made larger than the required copy size or deliberately set &o the longest possible distance, while the part of the photosensitive member outside the copy size is uniformly exposed to light. At least when the small size copy is taken, only the required size is developed, so that the additional time period can be provided prior to the next developing operation, and during the additional time period, the toner replenishment and stirring operations can be carried out sufficiently, thus making possible the stabilized developed image formation.

As for the change of the scanning distance itself, there is prior art, U.S. Pat. No. 4,183,656 (Ishihara et al), which, however, is essentially different from the change of the scanning distance.

In the present invention, the increase of the scanning distance can be replaced by decrease of the speed of the backward movement (non-image forming operation) of the scanning optical system as compared with the normal image forming mode.

Figure 4:
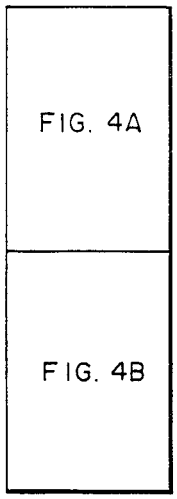
FIG. 4 is a flow chart illustrating an operation of an image forming apparatus according to another embodiment.
Figure 4A:
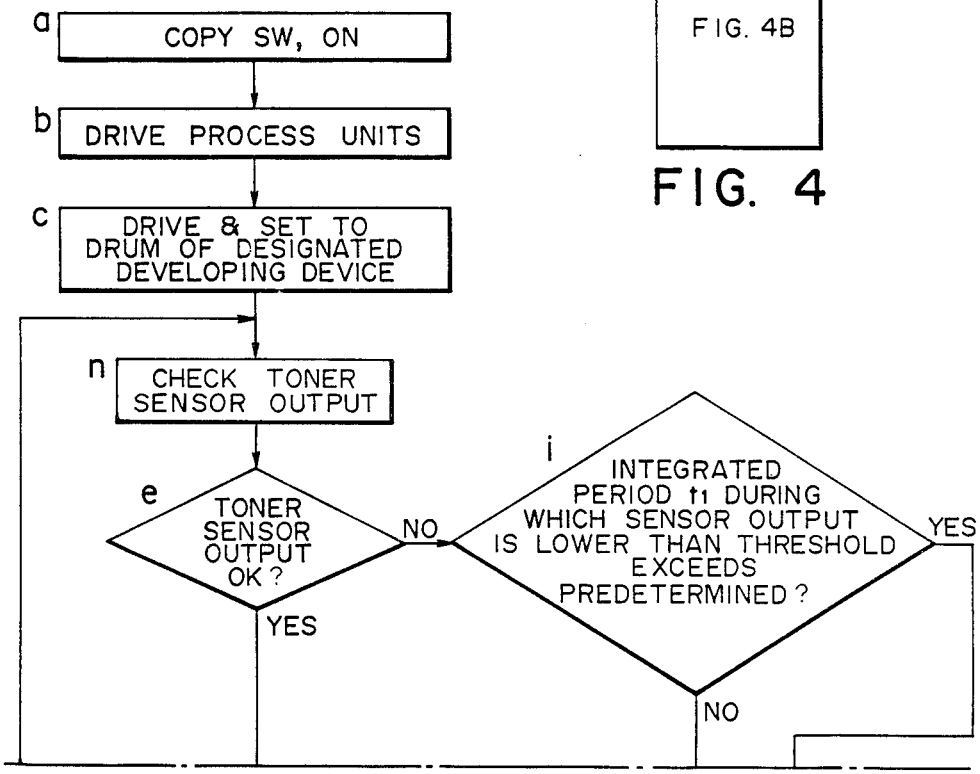
Figure 4B:
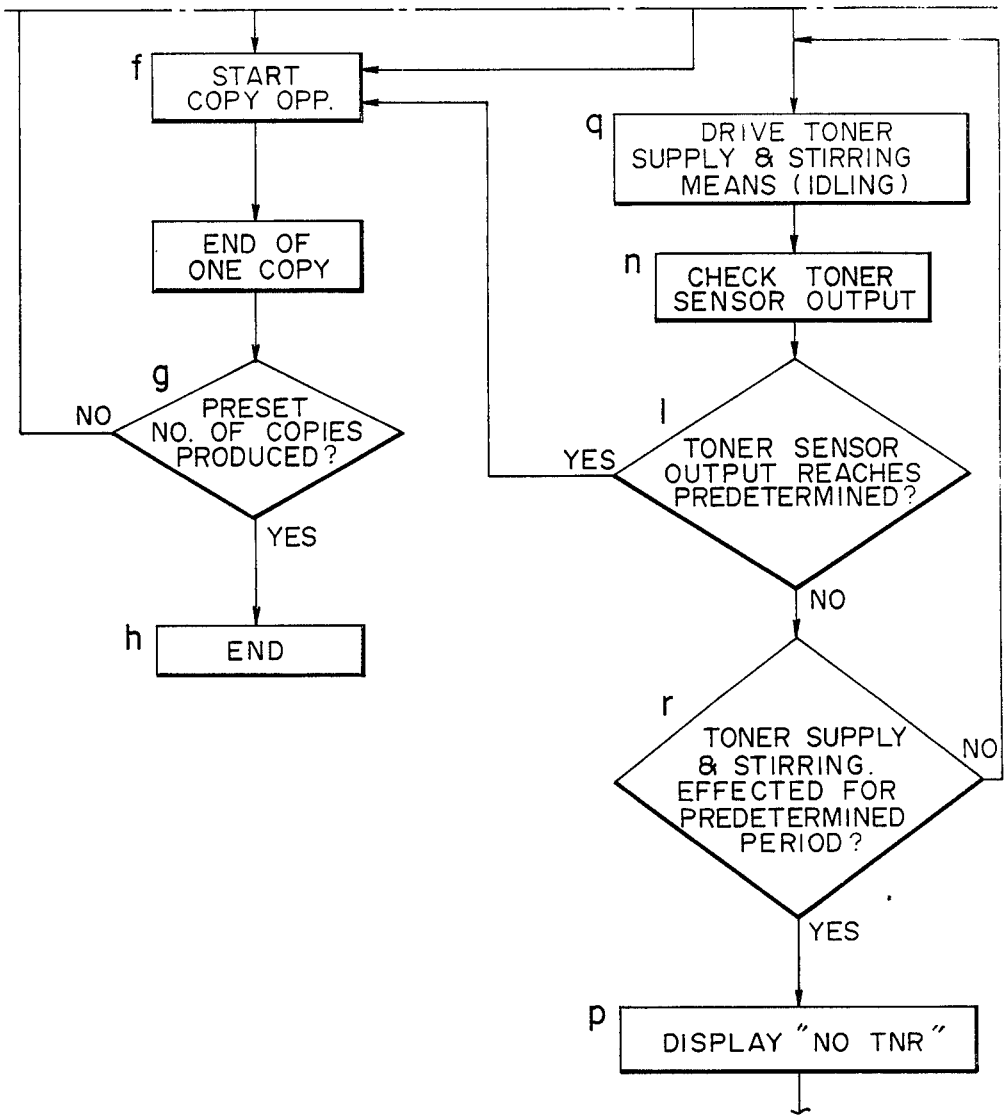

FIG. 4 illustrates another embodiment of the present invention, wherein the amount of the toner replenishment per unit time is made smaller than the amount of toner consumption when a solid black image is copied. When a substantially solid black original is copied, the amount of the toner replenishment is not sufficient, resulting in a deteriorated quality of the image. In order to prevent this, when the toner sensor output is kept lower than a threshold for a predetermined period of time, the copy operation is stopped, and the initial stabilizing period is used also for the replenishing and stirring of the toner. When the mixture ratio of the toner particles to the magnetic particles of the developer in the developer container reaches a predetermined value, the copying operation is resumed.

FIG. 4 is a flow chart of the apparatus of this example. Before each of the copy starting operations, the toner sensor output is always checked, and if the sensor output is above the predetermined, the copying operation starts. If it is below the predetermined threshold level, the integrated time period $t_1$ during which the sensor output is kept below the threshold is checked. If the time period is larger than a predetermined, the toner replenishing and stirring operation q (idling rotation mode) is performed until the sensor output reaches the threshold level. However, the idling rotation period is limited to $t_2$ (maximum), and the sensor output is not yet at the threshold level even after the time period of $t_2$, the discrimination is made that the toner is not replenished. Therefore, the "no toner" display is lit on. When the sensor output reaches the threshold, the copying operation is resumed. In this embodiment, the time period $t_1$ is preferably several seconds, since if it is too short, an erroneous operation easily occurs by which the idling rotation mode is immediately selected. If, on the other hand, it is too long, the toner content in the developer decreases with the integrated number of the copies, whereby even if the idling rotation mode is performed, a large amount of the toner is rapidly replenished and stirred, resulting in foggy background. The time period $t_2$ is determined on the basis of the time period $t_1$ and the accuracy of the toner content detection. In this embodiment, it has been found that when the $t_1$ is set to be 1–2 seconds, the time period $t_2$ is preferably 20–40 seconds without occurrence of erroneous operation. In this embodiment, the toner sensor output is checked for each of the copies, but this is not limiting, and the check is effected for each plural copies, or the check is effected always, and the necessity of the idling rotation mode is determined after each of the copy operations. The structures of the developing device and the method of detecting the toner content are not limited to those disclosed with this embodiment.

As described in the foregoing, according to this embodiment of the present invention, a high quality of the developed image without foggy background can be provided stably even in a small size developing device. Also, a common means is used for detecting "no toner" in the toner container and for detecting and controlling the mixture ratio of the toner to the magnetic particles in the developer container. Therefore, the developing device can be provided which is simple in structure, inexpensive in manufacturing and is space-saving.

Additionally, according to the present invention, the possible instability of the developer can be avoided, so that a high quality image can be assured, and therefore, a wasteful copying or printing or recording operation can be avoided.

Figure 5:
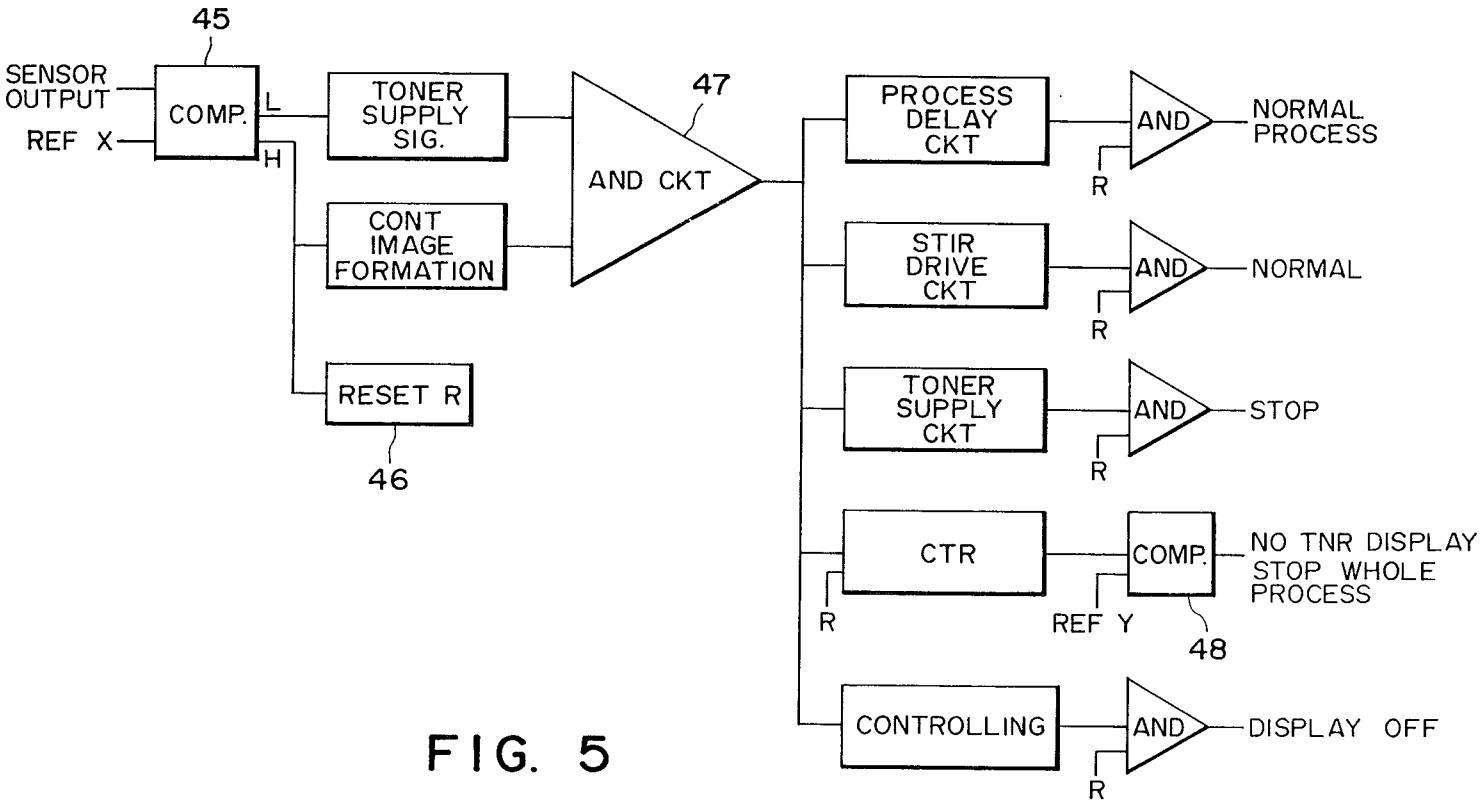
FIG. 5 is a block diagram.

FIG. 5 illustrates a part of the control system, wherein the single-copy taking operation is omitted.

A comparator 45 compares the toner content sensor output with a reference level X. When the sensor output is lower than the reference level, a signal L is produced which represents the necessity of the toner replenishment. If it is higher than the reference, the resetting signal R is produced. An AND circuit 47 is responsive to the toner replenishing signal and the signal representing the continuous image formation mode selected, and actuates a process delaying circuit for stopping the processing operation, for delaying the time until the image formation start as compared with the normal state, or the like (a stirring means driving circuit, if it is in operation in the developing operation, it may be continued), a toner replenishing circuit, a counter for counting the above described time $t_2$ and the display 41 for displaying "on control". Those elements are stopped or stabilized by the above described resetting signal. However, the count of the counter is compared with a reference Y, and when it exceeds the reference Y, the "no toner" is displayed on the display 42, and in that case, the entire processing operation including the operations of the blocks of FIG. 5 is stopped. As described, according to the present invention, the present invention is particularly suitable to a small size device in which efficient toner control is difficult due to the small size, and therefore, the present invention makes it possible to provide a high quality image even in such small sized device.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus for forming an image using two component developer, comprising:

means for continuously executing an image forming operation in a predetermined image formation mode using two component developer containing mixture of toner powder and magnetic powder;

means for detecting the toner content in the two component developer;

means for supplying toner powder to said image forming means;

means for mixing the two component developer; and control means for controlling said image forming means to execute the image forming operation in a delayed image formation mode and for controlling said toner powder supplying means and said mixing means to execute their respective supplying and mixing operations when said detecting means detects a predetermined decrease in the toner content during execution of the image forming operaton in the predetermined image formation mode, said control means being operative to automatically reset the image formation to said predetermined image formation mode.

2. An apparatus according to claim 1, wherein said control means tentatively stops the image forming operation in the image formation mode.

3. An apparatus according to claim 1, wherein said executing means includes means for forming an electrostatic latent image by optical means on a photoconductive image bearing member, means for developing the electrostatic latent image with the toner powder, wherein said control means delays the start of the latent image formation by said optical means.

4. An apparatus according to claim 1, wherein said control means resumes the image forming operation in the predetermined image formation mode when the toner content reaches a level capable of the image formation.

5. An image forming apparatus for forming an image using two component developer, comprising:

image forming means for continuously forming images, including developing means for developing latent images on an image bearing member using two component developer containing a mixture of toner powder and magnetic powder;

means for detecting the toner content in the developer in said developing means;

means for supplying toner powder to said developing means;

means for mixing the two component developer; and control means for controlling operation of said image forming means in accordance with an output of said detecting means, said control means causing the image forming operation to temporarily stop and causing said toner powder supplying means and mixing means to execute their respective supplying and mixing operations when said detecting means detects that the toner content in below a predetermined range, said control means causing the image forming operation to resume when said detecting means detects that the toner content has been raised to within the predetermined range.

6. An apparatus according to claim 5, wherein said control means includes display means for warning, when the toner content does not reach the predetermined region even when the toner supply and stirring operations are performed for a predetermined period of time.

7. An image forming apparatus for forming an image using two component developer, comprising:

image forming means for continuously forming images, including means for exposing a photosensitive member retaining uniform electric charge with a light image provided by relative movement between an original and an illumination and optical system to form a latent image on the photosensitive member, and means for developing the latent image with two component developer containing a mixture of toner powder and magnetic powder;

means for detecting toner content in the developer in said developing means;

means for supplying toner powder to said developing means;

means for mixing the two component developer; and control means for controlling operation of said image forming means in accordance with an output of said detecting means, wherein said control means, when the toner content is below a predetermined range during the continuous image forming operation, causes the relative movement between the original and the illumination and optical system to be longer than a required copy length or to be an operable largest length, while causing said toner powder supplying means and said mixing means to execute their respective supplying and mixing operations, and wherein said control means causes the relative movement between the original and the illumination and optical system to be reset for the required copy length when said detecting means detects that the toner content has been raised to within the predetermined range.

8. An image forming apparatus for forming an image using two component developer, comprising:

means for continuously executing image forming operation in a predetermined image formation mode using two component developer containing a mixture of toner powder and magnetic powder;

means for detecting the toner content in the two component developer;

means for supplying toner powder to said developing means;

means for mixing the two components developer; and control means for controlling said image forming means to execute the image forming operation in a delayed image formation mode and for controlling said toner powder supplying means and said mixing means to execute their respective supplying and mixing operations when said detecting means detects a predetermined decrease in the toner content during execution of the image forming operation in the predetermined image formation mode, said control means being operative to automatically reset the image formation to said predetermined image formation mode and including warning means for issuing a warning when the toner content is not sufficiently increased within a predetermined period of time.

* * * * *

UNITED STATES PATENT AND TRADEMARK OFFICE

CERTIFICATE OF CORRECTION

PATENT NO. : 4,777,512

DATED : October 11, 1988

INVENTOR(S) : MASAYOSHI TAKAHASHI, ET AL.

It is certified that error appears in the above-identified patent and that said Letters Patent is hereby corrected as shown below:

COLUMN 1

Line 47, "extent, the" should read --extent, and the--.

COLUMN 3

Line 50, "fourth mirror 34." should read --fourth mirror 39.--.
Line 55, "They," should read --They--.
Line 62, "of one half that" should read --one half that of--.

COLUMN 5

Line 11, "photo-sensitive" should read --photosensitive--.
Line 30, "a" should read --an--.

COLUMN 6

Line 4, "are" should read --is--.
Line 30, "are" should read --is--.

COLUMN 7

Line 23, "remaining" should read --remainder--.
Line 34, "container 1" should read --container 4--.
Line 57, "is" should be deleted.

UNITED STATES PATENT AND TRADEMARK OFFICE

CERTIFICATE OF CORRECTION

PATENT NO. : 4,777,512

DATED : October 11, 1988

INVENTOR(S) : MASAYOSHI TAKAHASHI, ET AL.

It is certified that error appears in the above-identified patent and that said Letters Patent is hereby corrected as shown below:

COLUMN 9

Line 42, "&o" should read --to--.

COLUMN 11

Line 35, "mixture" should read --a mixture--.
Line 48, "operaton" should read --operation--.

COLUMN 12

Line 20, "in" should read --is--.

COLUMN 13

Line 7, "components" should read --component--.

Signed and Sealed this

Sixth Day of March, 1990

*Attest:*

JEFFREY M. SAMUELS

*Attesting Officer*

*Acting Commissioner of Patents and Trademarks*